US005785064A

United States Patent [19]

Simpson

[11] Patent Number: 5,785,064

[45] Date of Patent: Jul. 28, 1998

[54] HIGH TEMPERATURE EXTERNALLY HEATED HAIR-STYLING DEVICES

[76] Inventor: Timothy A. Simpson, 1574 Sugar Maple Way, West Bloomfield, Mich. 48324

[21] Appl. No.: 813,856

[22] Filed: Mar. 7, 1997

[51] Int. Cl.[6] ..... A45D 2/12

[52] U.S. Cl. ..... 132/226; 132/269; 116/216; 219/219; 219/241; 219/225; 219/222

[58] Field of Search ..... 132/269, 118, 132/227, 229, 233, 117, 226; 116/216, 217, 221; 219/219, 240, 241, 225, 222

[56] References Cited

U.S. PATENT DOCUMENTS

| | | | |
|---|---|---|---|
| D. 253,849 | 1/1980 | Schroeder . | |
| D. 324,586 | 3/1992 | Montagnino et al. . | |
| 2,420,969 | 5/1947 | Newell | 116/216 |
| 2,648,757 | 8/1953 | Harper | 132/118 |
| 3,253,572 | 5/1966 | Lindberg, Jr. | 116/216 |
| 3,416,543 | 12/1968 | Hantman . | |
| 3,581,056 | 5/1971 | Djenner . | |
| 3,600,552 | 8/1971 | Tolmie | 219/222 |
| 3,658,071 | 4/1972 | Wise . | |
| 3,665,938 | 5/1972 | Pedersen . | |
| 3,959,787 | 5/1976 | Messmann et al. | 116/216 |
| 4,034,762 | 7/1977 | Cosens et al. | 219/240 |
| 4,102,194 | 7/1978 | Eng | 374/167 |
| 4,103,145 | 7/1978 | Oliveri . | |
| 4,124,034 | 11/1978 | Meyerhoefer . | |
| 4,126,143 | 11/1978 | Schroeder . | |
| 4,142,151 | 2/1979 | Hansen | 116/216 |
| 4,257,434 | 3/1981 | Wahl | 132/118 |
| 4,288,271 | 9/1981 | Campbell, Jr. et al. | 219/241 |
| 4,347,428 | 8/1982 | Conrad et al. | 219/241 |
| 4,593,708 | 6/1986 | Goeller . | |
| 4,803,341 | 2/1989 | Barowski et al. . | |
| 4,829,155 | 5/1989 | Fukutuka et al. . | |
| 4,883,942 | 11/1989 | Robak, Sr. et al. | 219/227 |
| 4,968,870 | 11/1990 | Moon . | |
| 5,021,634 | 6/1991 | Santoro et al. | 219/241 |
| 5,046,516 | 9/1991 | Barraddas . | |
| 5,091,629 | 2/1992 | McGee . | |
| 5,099,106 | 3/1992 | Biancone | 219/241 |
| 5,151,574 | 9/1992 | Urban | 219/241 |
| 5,270,520 | 12/1993 | Barzilai et al. | 219/225 |
| 5,354,967 | 10/1994 | Brazilai et al. . | |
| 5,598,085 | 1/1997 | Hasler | 320/21 |

*Primary Examiner*—Gene Mancene
*Assistant Examiner*—Eduando C. Robert
*Attorney, Agent, or Firm*—Ernest E. Helms

[57] ABSTRACT

A high temperature externally heated hair-styling device is provided which has a hair-styling body. An over-temperature alarm is mounted in the hair-styling body. The over-temperature alarm has a temperature sensor which is thermally connected to the hair-styling body. The sensor provides a voltage signal representative of the temperature of the hair-styling body. A variable reference voltage signal generator is powered by a DC battery power source. The reference signal generator has an adjustable range and the reference voltage signal is calibrated to coincide with a predefined operating temperature range. A comparative device comparing the representative and reference voltage signals is used to determine when the predefined operating temperature range is exceeded. An indicator device responsive to the comparative device is used to indicate a temperature of the hair-styling body exceeding the predefined operating temperature range of the hair-styling body. An on/off switch is used to connect or disconnect the reference voltage signal generator from the DC power source.

11 Claims, 5 Drawing Sheets

HIGH TEMPERATURE EXTERNALLY HEATED HAIR-STYLING DEVICES

BACKGROUND-FIELD OF INVENTION

This invention relates to a high temperature externally heated hair-styling device having a temperature sensor mounted therein and thermally connected to the temperature sensor is a temperature sensing circuit and an over-temperature alarm circuit comprised of a visual and an audible alarm.

DISCLOSURE STATEMENT

Many hair-styling devices must be heated to create various hair styling effects in human hair. Some hair styling devices are self heated by electrical power. Others must be externally heated by direct contact with a high temperature heat source such as an electrical-heating element, a gas flame, or a small electrical-heat oven. The temperature of an internally heated electrically powered hair-styling device can be set by a user and is controllably maintained by an electrical circuit that receives input from an internally mounted temperature sensing element. However, most internally heated electrically heated hair-styling devices must be hollow to receive a self contained heating coil. The results is a rapid reduction of temperature when the hair-styling device is placed in a user's hair. If the hair-styling device is externally heated, the hair-styling device can have a greater mass and larger heat capacity. Therefore, for many hair-styling applications where a constant high temperature is desired, a high temperature externally heated hair-styling device is preferred. One application where a hair-styling device with a higher heat capacity is a significant advantage is in the styling of naturally curly hair.

A user of a high temperature externally heated hair-styling device must rely on experience to determine if the device has been over heated beyond a "predefined operating temperature". The term "predefined operating temperature" applies hereinafter to a hair-styling device's temperature that can contribute to damage or breakage of a user's hair. Accordingly, there is a distinct need for a temperature sensor coupled with a over-temperature warning system for high temperature externally heated hair-styling devices.

Prior art have used various electronic circuitry to provide power to certain kinds of electrically heated hair-styling devices, as describes in U.S. Pat. No. 4,124,034 which uses a time-temperature device to control a curling-rod's temperature based on hair temperatures as measured by a temperature measuring element attached to the hair. Alternatively, a temperature sensor attached to a curling tube's internal diameter is used with a power control circuit to provide electrical power to a heater element as described in U.S. Pat. No. 5,354,967 and U.S. Pat. No. 4,968,870.

Low-temperature externally heated hair-styling devices, have used mechanical means to indicate temperatures. A bimetallic element is used to indicate a range of temperatures of a hair roller as described in U.S. Pat. No. 3,658,071, or a predetermined color is used to display a bobbin's temperature of a hair-styling device used to curl hair as depicted in U.S. Pat. No. 4,829,155.

The aforementioned externally heated hair-styling devices are generally heated within a temperature range of 50° C. to 120° C. using a temperature-limited heat source. Conversely, high temperature externally heated hair-styling devices, which are the scope of the present invention, are generally heated using heat sources (such as a gas flame) that can produce excessive temperatures that can potentially contribute to damage of a user's hair.

Accordingly, it is a primary objective of the present invention to provide a high temperature externally heated hair-styling device with a visual and an audible over-temperature alarm to warn a user when the device reaches an unsafe operating temperature. It is a secondary objective to provide a user with an adjustable temperature indication range so that when a selected set point is exceeded an over-temperature alarm will alert the user. A third objective of the present invention is to provide a user of a high temperature externally heated hair-styling device with an indication of the device's operating temperature to prevent hair damage.

SUMMARY OF INVENTION

In the present invention, a high temperature externally heated hair-styling device; i.e., hair-straightening comb or hair-curling rod connected with an internal temperature sensor. A handle being receivable of the shaft end of the high temperature externally heated hair-styling device has mounted thereon an on/off switch, a power-on indicator light, a variable thermostat and, an over-temperature indicator light. The handle has internally mounted therein, an over-temperature audible alarm, and an electronic-circuit board, powered by a battery.

As the temperature of an externally heated hair-styling device of the present invention changes the temperature sensor's output voltage eventually matches a reference voltage supplied by the variable thermostat. An electronic circuit comprised of an operational amplifier, a switching device, and other electronic components receives the voltage signals from the temperature sensor and variable thermostat. The operational amplifier continuously compares input voltages from the thermostat and temperature sensor. When the voltages are of equal magnitude the operational amplifier switches a transistor to an "on" state. The transistor in turn drives a relay that switches current to an alarm circuit simultaneously activating an over-temperature indicator light and an alarm.

The manner in which to use the preferred embodiment of the present invention is to align a thermostat dial pointer to a "low," "medium" or "high" temperature setting corresponding to a specific hair quality, hair condition or hair procedure. For example, a "low," "medium" or "high" temperature setting can corresponding to; 1) fine, medium, or a tightly curled hair quality, 2) dry, regular or an oily hair condition or, 3) a desired hair straightness or curl size. The hair-styling device generally receives heat by convection or conduction from an external heating source. The temperature-sensing circuit is preferably calibrated to temperatures within a safe operating range as determined by the hair-styling profession. An important feature of the present invention is, the circuit is preferably designed to respond to temperatures that exceeds a desired set point, including a maximum set-point temperature indication.

The variable thermostat having a dial pointer is used to set a maximum temperature at which the audible over-temperature alarm and indicator light will activate when the high temperature externally heated hair-styling device reaches a temperature determined unsafe by its user. The over-temperature alarms will continue to activate until the hair-styling device is removed from the heat source and allowed to cool below its set-point temperature; at which time the over-temperature alarms becomes disabled indicating that the device is safe to use.

An advantage of the present invention having an audible over-temperature alarm is to alert a user to remove a hair-styling device from the heat source if left unattended. Another advantage of the present invention having an over-temperature flashing light is that it provides a visible signal as to which hair-styling device is overheating when several devices are being used simultaneously in a hair salon.

BRIEF DESCRIPTION OF DRAWINGS

A preferred embodiment of the present invention is illustrated in the accompanying figures.

DETAILED DESCRIPTION OF DRAWINGS

Figure 1:
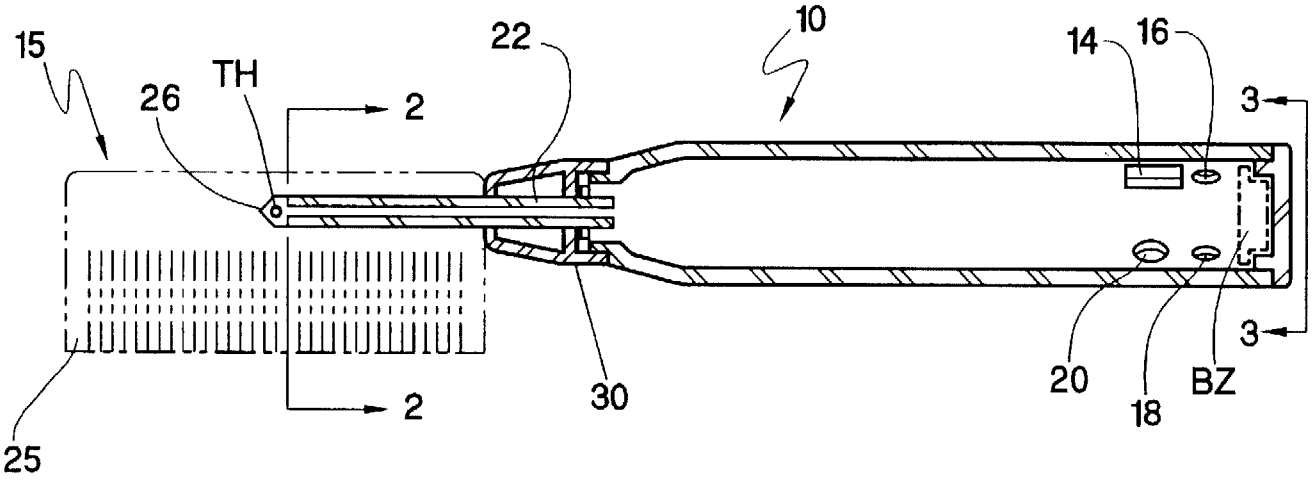
FIG. 1 is a perspective view with portions sectioned of a preferred embodiment high temperature externally heated hair-styling device of the present invention.

A high temperature externally heated hair-styling device 15 has a body which includes a comb portion 25, a handle coupling 30, and a handle 10. As illustrated in FIG. 1, the handle 10 is comprised of a rectangular hole 14, a round hole 16, a round hole 18, and a round hole 20. Through hole 14 there extends an on/off switch SW. A light emitting diode D1 and D3 extends through holes 16 and 18, respectively. Through hole 20 there extends the shaft of a thermostat or variable potentiometer R2 to which a dial pointer 24 is attached. The dial 24 may point directly to, or in between a pair of a series of indications such as "L," "M" and "H" indicating a desired temperature setting for a certain hair-styling procedure or hair quality. These indications are referred to as "low," "medium" and "high" and are preferably used as a guide in the safe use of an externally heated hair-styling device.

Figure 4:
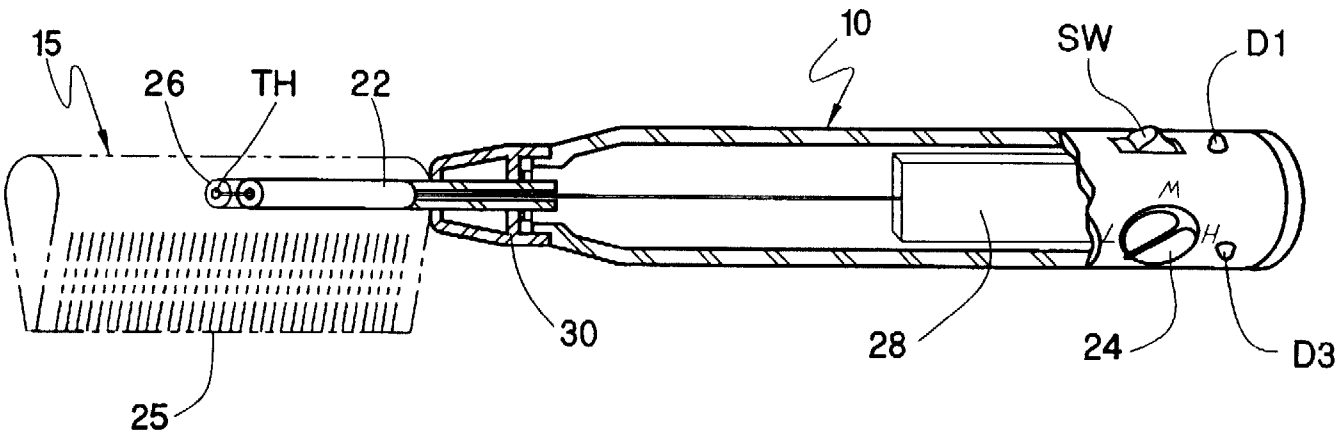
FIG. 4 is a cross sectional isometric view of a preferred embodiment of the present invention showing a handle and components mounted thereon.
Figure 5:
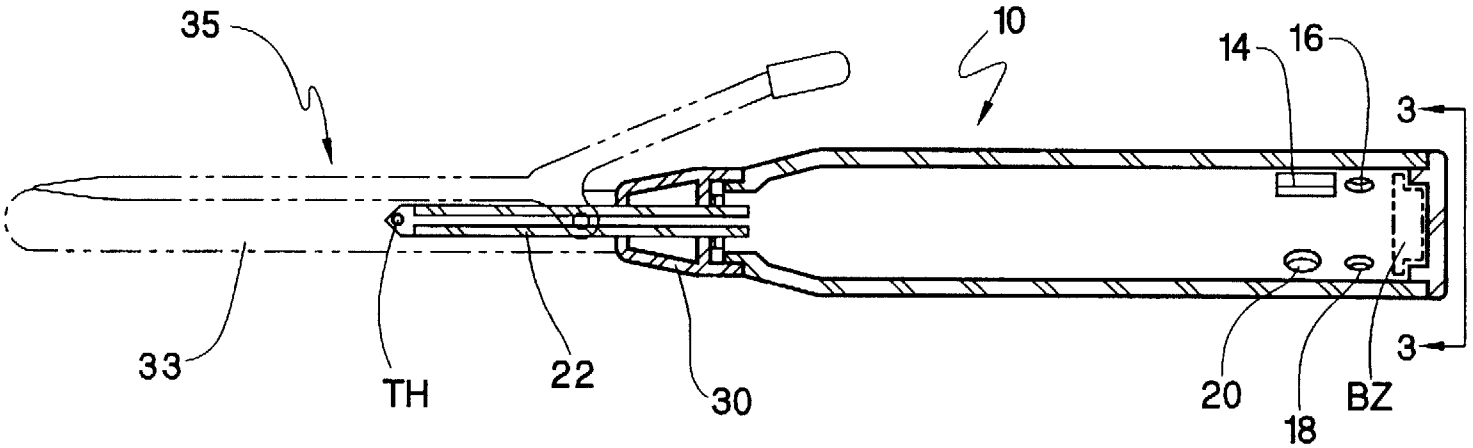
FIG. 5 is a perspective view with portions sectioned of an alternate preferred embodiment curling rod high temperature externally heated hair-styling device of the present invention.

The high temperature externally heated hair-styling device 15 is a straightening comb used to straightened curly human hair. As shown in FIG. 1 the high temperature externally heated hair-styling device 15 has a blind hole 26 midway between a first and a second side edge. The hole is preferably threaded to receive a threaded tube 22. A temperature sensing end of a temperature sensor TH is thermally connected with the body of the high temperature externally heated hair-styling device 15. The temperature sensor extends through the tube's internal diameter and terminates at the bottom of the hole 26. The temperature sensing end of the sensor in surrounded by a high temperature epoxy resin with a sufficient heat transfer coefficient. The temperature sensor lead wires extend from the end of the tube 22 and are connected to an electrical circuit board 28 as shown in FIG. 4. In an alternate preferred embodiment the temperature sensor is internally mounted to a body 35 which has a curling rod portion 33, as illustrated in FIG. 5. The handle 10 being preferably comprised of a polymeric heat resistant material is isolated from direct contact with the hair styling device by a coupling 30 comprised of a thin-shell metallic material. The handle's cross-section is generally circular, as shown in FIG. 4, but can be comprised of other shapes. The handle is preferably comprised of two halves having a sufficiently large internal diameter to enclose the circuit board 28.

Figure 3:
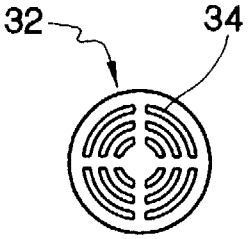
FIG. 3 is a cross section end view of a handle of a preferred embodiment of the present invention showing an end piece thereof having a plurality of semi-circle slotted holes.
Figure 2:
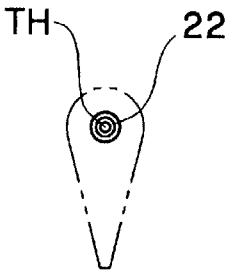
FIG. 2 is an end view of a cross section of a high temperature externally heated straightening comb.

A piezo sounder audio indicator BZ alarm is preferably connected to the circuit board 28 via wires so it can be located behind an end piece 32 of the handle 10 as shown in FIG. 3. The handle's end piece having a plurality of semi-circular holes 34, from which the piezo sounder is audible, is securely snapped onto the handle 10. The importance of such a feature is to provide easy accessibility to a battery preferably located behind end piece 32.

Figure 6:
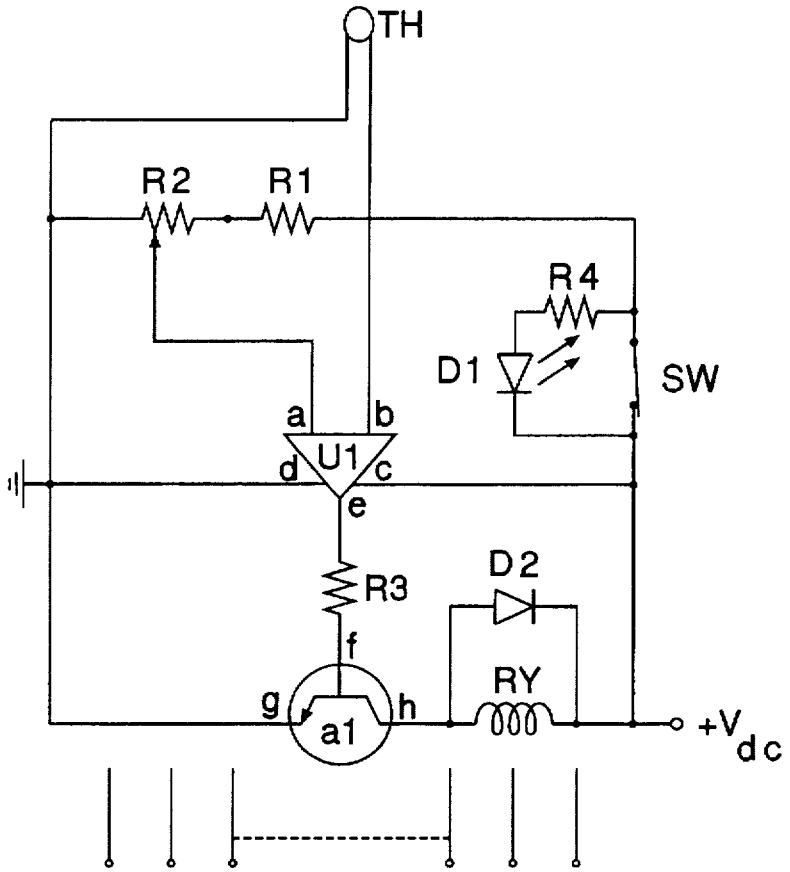
FIG. 6 is an electrical schematic diagram of the temperature sensing circuit of a preferred embodiment of the present invention.

The electrical circuit, as shown in FIG. 6, has an on/off switch SW and a power-on indicator D1 that illuminates when the device is turned on. The electrical circuit is preferably comprised of a first and a second circuit connected via a relay RY. The first and second circuit will hereinafter be referred to as a temperature sensing and an over-temperature alarm circuit, respectively. The temperature sensing circuit of the preferred embodiment of the present invention is comprised of a temperature sensor TH, which supplies a hair-styling device's body temperature representative voltage signal, a resistor R1 and a variable potentiometer R2. An operational amplifier U1 is used in the temperature sensing circuit as a voltage comparator. The operational amplifier drives a transistor Q1 which energizes the relay RY to activate the over-temperature alarm circuit.

An electrical schematic diagram of a temperature sensing circuit is depicted in FIG. 6. The temperature sensor TH has a positive lead that connects to a pin "b" of the operational amplifier U1 and a negative lead that connects to ground. The resistor R1 and the variable potentiometer R2 are connected in series having an end connected to the battery's positive terminal and the other end is connected to ground. In the preferred embodiment of the present invention the resistance value of R1 sets the battery voltage threshold value. The battery voltage threshold, which is a generated reference voltage adjustable via the variable potentiometer R2, is connected to a pin "a" of the operational amplifier U1. The operational amplifier U1 continuously compares the temperature sensor voltage to a set-point reference voltage. When a set-point reference voltage is exceeded, during heat absorption of the hair-styling device, the operational amplifier U1 directs current from a pin "d" thereof to the base lead "f" of a transistor Q1. The transistor Q1, being used in either a fully on or off state drives, a relay RY connected to its collector lead "h" thus activating the over-temperature alarm circuits depicted in FIG. 6A and 6B. As the hair-styling device cools the voltage of the temperature sensing device decreases below a set-point reference voltage and the over-temperature alarm circuits are disabled.

Figure 6A:
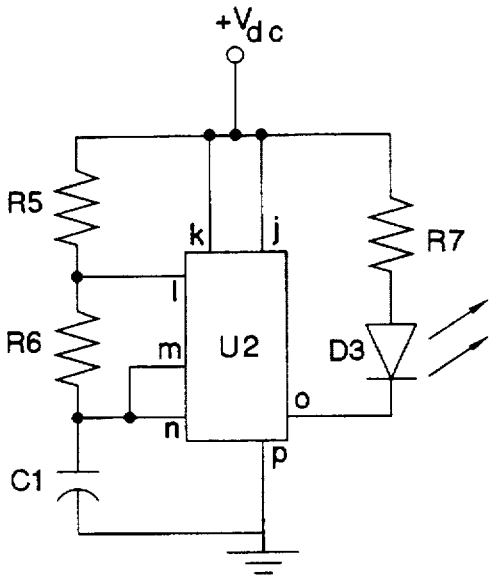
FIG. 6A is an electric schematic diagram of the visual over-temperature alarm circuit of a preferred embodiment of the present invention.
Figure 6B:
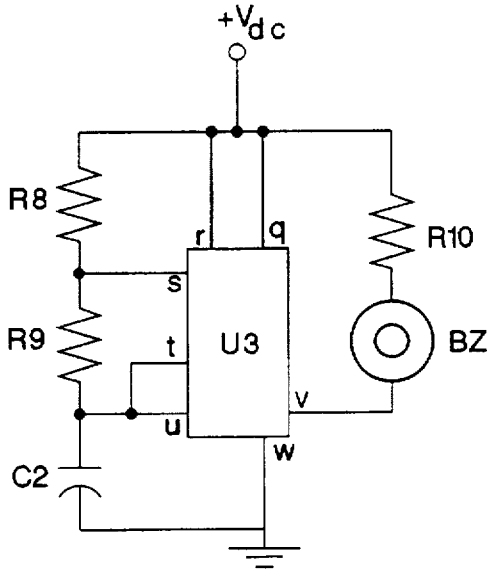
FIG. 6B is an electric schematic diagram of the audible over-temperature alarm circuit of a preferred embodiment of the present invention.

An over-temperature alarm circuit in the preferred embodiment of the present invention is comprised of two separate responsive circuits; a LED flashing circuit and a pulsating piezo sounder circuit. The LED flashing circuit, as shown in FIG. 6A, is preferably comprised of a first timer IC U2, a plurality of resistors R5, R6 and R7, a capacitor C1 and a LED D3. Similarly, the pulsating piezo sounder circuit is comprised of a second timer IC U3, a plurality of resistors R8, R9 and R10, a capacitor C2 and a piezo sounder BZ. The first timer IC U1 drives the LED D3 via a pin "o" at a frequency determined by the resistor R6 and capacitor C1 combination. A current limiter for the LED D3 is provided by a resistor R7 as shown in FIG. 6B. The second timer IC U3 drives a piezo sounder BZ via a pin "v" at a frequency determined by the resistor R9 and the capacitor C2 combination. The current to the piezo sounder BZ is limited by a resistor R10 as shown in FIG. 6A.

Although the descriptions above contains many specificities, these should not be construed as limiting the scope of the invention but as merely providing illustrations of some of the presently preferred embodiments of this invention. For example, a flip-flop IC can be used to drive the LED and piezo sounder. The temperature sensing circuit can be modified to include a LED that illuminates when an externally heated hair-styling device reaches a minimum desired operating temperature. The LED visual over-temperature alarm can be eliminated from the circuit if it is determined that an audio alarm is adequate. The temperature sensing circuit can comprise a thermocouple, thermistor or temperature sensing diode to respond to the temperature of an externally heated hair-styling device. The threaded tube may be replaced by a tube that is pressed into the hair-styling device.

In accordance with the provisions of the patent statutes, the principles and mode of operation of this invention have been explained and illustrated in its preferred embodiment. However, it must be understood that this invention may be practiced otherwise than as specifically explained and illustrated without departing from its spirit or scope.

I claim:

1. A high temperature hair styling device comprising:

a high heat capacity externally heated hair styling body;

an over temperature alarm mounted in the hair styling body, the over temperature alarm including:

a temperature sensor thermally connected to the hair styling body, the sensor providing a voltage signal representative of a temperature of the hair styling body;

a variable reference voltage signal generator powered by a DC battery power source having an adjustable range whereby the reference voltage signal is calibrated to coincide with a predefined operating temperature range;

a comparative device comparing the representative and reference voltage signals to determine when the predefined operating temperature range is exceeded;

an indicator device responsive to the comparative device to indicate a temperature of the hair styling body exceeding the predefined operating temperature range of the hair styling body; and an on/off switch to connect or disconnect the reference voltage signal generator from the DC power source.

2. A high temperature externally heated hair styling device as described in claim 1 wherein the indicator device provides a light generating a visual signal.

3. A high temperature externally heated hair styling device as described in claim 1 wherein the indicator device provides an audible signal.

4. A high temperature externally heated hair styling device as described in claim 1 wherein the temperature sensor is a thermistor.

5. A high temperature externally heated hair styling device as described in claim 1 wherein the temperature sensor is a thermocouple.

6. A high temperature externally heated hair styling device as described in claim 1 wherein the temperature sensor is a diode.

7. A high temperature externally heated hair styling device as described in claim 1 wherein the indicator device provides a visual signal by a first LED and an audible signal.

8. A high temperature externally heated hair styling device as described in claim 7 wherein the LED flashes and said audible signal pulsates.

9. A high temperature externally heated hair styling device as described in claim 1 wherein the variable reference voltage signal generator includes a circuit comprised of a battery, a resistor and a variable potentiometer combination.

10. A high temperature externally heated hair styling device as described in claim 1 wherein the hair styling device can be used when the switch is disconnecting the reference voltage signal generator.

11. A high temperature hair styling device comprising:

a high heat capacity externally heated hair styling body;

an over temperature alarm mounted in the hair styling body, the over temperature alarm including:

a temperature sensor thermally connected to the hair styling body, the sensor providing a voltage signal representative of a temperature of the hair styling body;

a variable reference voltage signal generator powered by a DC battery power source having an adjustable range whereby the reference voltage signal is calibrated to coincide with a predefined operating temperature range;

a comparative device comparing the representative and reference voltage signals to determine when the predefined operating temperature range is exceeded;

visual and audible indicator devices responsive to the comparative device to indicate an operating temperature exceeding the predefined operating temperature range of the hair styling body, both indicator devices being deactivated when the hair styling device temperature is lowered to return to the predefined operating temperature range of the hair styling body; and an on/off switch to connect or disconnect the reference voltage signal generator from the DC power source.

* * * * *